US010745894B2

(12) United States Patent
Colombo

(10) Patent No.: US 10,745,894 B2
(45) **Date of Patent: *Aug. 18, 2020**

(54) UNIVERSAL EMBEDDED SYSTEM FOR SANITARY FAUCET COMPONENTS

(71) Applicant: FIR ITALIA S.p.A., Milan (IT)

(72) Inventor: Nicola Colombo, Milan (IT)

(73) Assignee: FIR ITALIA S.P.A., Milan (IT)

( * ) Notice: Subject to any disclaimer, the term of this patent is extended or adjusted under 35 U.S.C. 154(b) by 28 days.

This patent is subject to a terminal disclaimer.

(21) Appl. No.: 16/192,101

(22) Filed: Nov. 15, 2018

(65) Prior Publication Data

US 2019/0085537 A1 Mar. 21, 2019

Related U.S. Application Data

(63) Continuation of application No. 15/556,315, filed as application No. PCT/IB2016/000298 on Mar. 15, 2016, now Pat. No. 10,138,619.

(30) Foreign Application Priority Data

Mar. 16, 2015 (IT) ..... MI2015A0394

(51) Int. Cl.
*E03C 1/02* (2006.01)
*E03C 1/23* (2006.01)

(52) U.S. Cl.
CPC ..... *E03C 1/021* (2013.01); *E03C 1/23* (2013.01); *E03C 2001/028* (2013.01); *Y10T 137/5196* (2015.04); *Y10T 137/698* (2015.04)

(58) Field of Classification Search
CPC ... E03C 1/01; E03C 1/02; E03C 1/021; E03C 1/042; E03C 2001/028; E03C 2201/30; E03C 2201/50; E03C 2201/80; E03C 1/23; Y10T 137/5196; Y10T 137/698
See application file for complete search history.

(56) References Cited

U.S. PATENT DOCUMENTS 5,418,986 A * 5/1995 Warkus ..... E03C 1/021 4/670
6,062,254 A * 5/2000 Brady ..... F16K 51/00 137/347
6,155,286 A * 12/2000 Geary ..... D06F 39/08 137/360
6,845,785 B1 * 1/2005 Condon ..... E03C 1/021 137/312
8,371,332 B2 * 2/2013 Cruickshank ..... F16K 27/0263 137/271
10,138,619 B2 * 11/2018 Colombo ..... E03C 1/021
(Continued)

FOREIGN PATENT DOCUMENTS

CN 103669495 A * 3/2014
EP 3088614 A1 * 11/2016 ..... E03C 1/021
WO WO-2013143336 A1 * 10/2013 ..... E03C 1/023

*Primary Examiner* — Kevin F Murphy
*Assistant Examiner* — Jonathan J Waddy
(74) *Attorney, Agent, or Firm* — King & Schickli, PLLC

(57) ABSTRACT

An universal embedding system (1) for sanitary faucets and fittings comprising three macro groups, a first universal embedding macro group, a second macro group of functional components (1B) such as mixers and switch valves and a third macro group of aesthetic parts (1C), wherein the first macro group comprises six connecting plugs for inlets (3") and outlets, which can freely be chosen.

5 Claims, 16 Drawing Sheets

(56) References Cited

U.S. PATENT DOCUMENTS

| | | | | |
|---|---|---|---|---|
| 2005/0067017 | A1* | 3/2005 | Condon | E03C 1/021<br>137/360 |
| 2011/0220221 | A1* | 9/2011 | Ball | E03C 1/042<br>137/357 |

* cited by examiner

UNIVERSAL EMBEDDED SYSTEM FOR SANITARY FAUCET COMPONENTS

This application is a continuation of Ser. No. 15/556,315 which claims priority to PCT/IB2016/000298 and MI2015A000394, all of which are incorporated by reference.

BACKGROUND OF THE INVENTION

The present invention relates to a universal embedding system, in particular for sanitary faucets or fittings.

A conventional embedding system for sanitary fittings provides to split to the embedding element into a pre-embedding generally plate-like part and a functional part.

Thus, by a single plate-like embedding element, it is possible to satisfy different operating functions, depending on the functional part which is applied to the embedding assembly or macro-group, for example only a shower, a shower with a fitting assembly, and so on.

Prior embedding systems functionally provide to use two inlets and two outlets (see for example FIG. 8), thereby, by the same embedding system, it is possible to make a comparatively small number of sanitary assemblies/groups.

Moreover, in prior embedding systems, each functional group or assembly is affixed to the plate-like element by fixed flange means, to which may be affixed or connected only a small number of functional components operating according to different operating manners.

Finally, even if prior embedding systems provide that the embedding macro-group is of a sealed type, wherein in case of a leakage of the overall box-like housing of the embedding system the water is conveyed inward, the prior sealing means, which comprise a simple snap engaging, use a gasket system of poor efficiency since it insulates only the top region of the embedding manifold body.

Document DE 10 2008 013694 B3 discloses substantially the preamble of claim 1.

SUMMARY OF THE INVENTION

Accordingly, in view of the above mentioned drawbacks of prior embedding systems, the aim of the present invention is to provide a universal modular embedding system, in particular for sanitary faucets or fittings, including two inlets and four outlets, thereby allowing to make an increased number of functional assemblies/groups by using the same macro-assembly or embedding part.

Within the scope of the above mentioned aim, a main object of the invention is to provide such a modular embedding system the functional components/groups of which may be split into modular elements, thereby optimizing a number of components/groups which could be made and with a further possibility of turning through 90° at least one element of each component/assembly.

Another object of the present invention is to provide such an embedding system including gasket means which are structurally very simple and may be assembled and disassembled in a very quick manner while being very efficient to protect at least an embedding functional part against possible water leakages.

A further object of the present invention is to provide such an embedding system which may be removably coupled to a support plate specifically designed for aiding a dry assembling of a desired functional group or assembly.

Another object of the present invention is to provide such an embedding system in which, during the assembling operating step, it is possible to select the assembling direction among four preset assembling directions, thereby allowing to use the same embedding macro-group to achieve, for each target configuration, four different functional components/groups.

A further object of the present invention is to provide such an embedding system including at least six functional assemblies/groups for achieving at least ten different functional operating combinations.

Another object of the present invention is to provide such an embedding system in which, depending on a position selected for the embedding macro-group and the functional macro-group itself, it is possible to connect a target outer part with remarkable aesthetic finishing features.

A further object of the present invention is to provide such an embedding system in which the outlet number (for example a maximum of four coplanar outlets or a frontal outlet) and the selection of the outlet to be used may be freely selected by a user and may be achieved preferably by a turning movement of the functional component/group.

A further object of the present invention is to provide such an embedding system allowing to reverse the water flows, in case a thermostatic cartridge is installed therein in an improper manner for a normal operation, and this without affecting the attachment of the embedding macro-group, and without a need of performing masonry operations, but by means of a simple rotary movement of the thermostatic drive or command unit.

Yet another object of the present invention is to provide such a universal embedding system the components of which may be made, at a competitive cost, starting from easily available materials, as well as by using existing machines or which may be easily designed and/or made by one skilled in the art.

According to one aspect of the present invention, the above mentioned aim and objects, as well as yet other objects, which will become more apparent hereinafter, are achieved by a universal embedding system for hydraulic faucets or fittings, having the features of the claim 1.

Further characteristics of the universal embedding system according to the present invention are set out in the dependent claims.

BRIEF DESCRIPTION OF THE DRAWINGS

Further details and advantages of the universal embedding system according to the present invention will become more apparent hereinafter from the following detailed disclosure of a currently preferred embodiment of said system being shown, by way of an indicative but not limitative example, in the accompanying drawings, where:

FIGS. 10, 10A and 10B to 11 are detail views of a manifold body of the embedding system according to the present invention;

FIG. 12 shows detail views of the embedding outlet plug of the manifold body;

FIG. 13 shows detail views of the embedding closure plug of the manifold body;

FIG. 14 shows detail views of a shaped gasket to be associated with the manifold body;

FIG. 15 shows further detail views of the bottom part of the box casing of the embedding system according to the present invention;

FIG. 16 shows further detail views of the top part of the box casing of the embedding system according to the present invention;

FIG. 17 shows further detail views of a depth bubble air level bearing plate constituting a possible functional group or assembly of the embedding system according to the present invention;

FIG. 18 shows detail views of a shower plug constituting a further possible functional assembly of the embedding system according to the present invention;

FIG. 19 shows further detail views of a further possible functional group or assembly, in particular an adapter for an embedding thermostatic cartridge;

FIG. 20 shows further detail views of a further possible functional group, in particular a mixer adapter;

FIG. 21 shows further detail views of a further possible functional group, in particular a mixer adapter to be associated with the embedding system according to the present invention;

FIG. 22 shows further detail views of a further possible functional group, in particular an adapter for a coaxial thermostatic cartridge;

FIG. 23 shows further detail views of a further possible functional group, in particular a two-outlet switching adapter;

FIG. 24 shows further detail views of a further possible functional group, in particular a two-outlet switching adapter;

FIG. 25 shows further detail views of a further possible functional group, in particular a four-outlet switching adapter;

FIG. 26 shows further detail views of an adapter for a four-outlet switching cartridge; and FIG. 27 shows further detail views of a further possible functional group, in particular a mouth adapter.

DESCRIPTION OF THE PREFERRED EMBODIMENTS

Figure 1C:
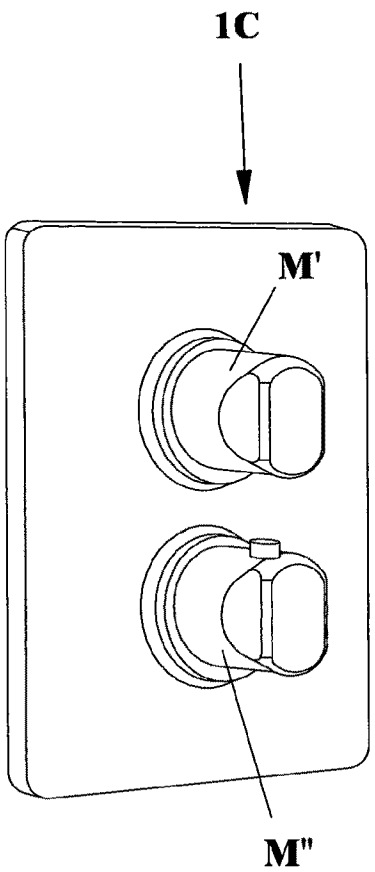
FIGS. 1A to 1C are perspective exploded views of the three main macro-groups of the embedding system according to the present invention.
Figure 1B:
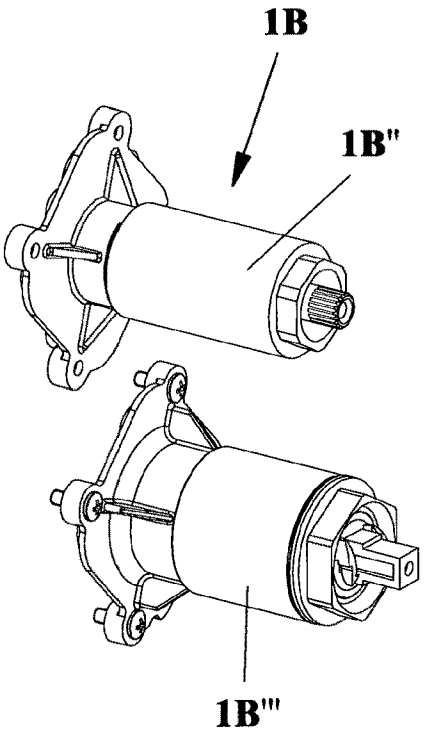
Figure 1A:
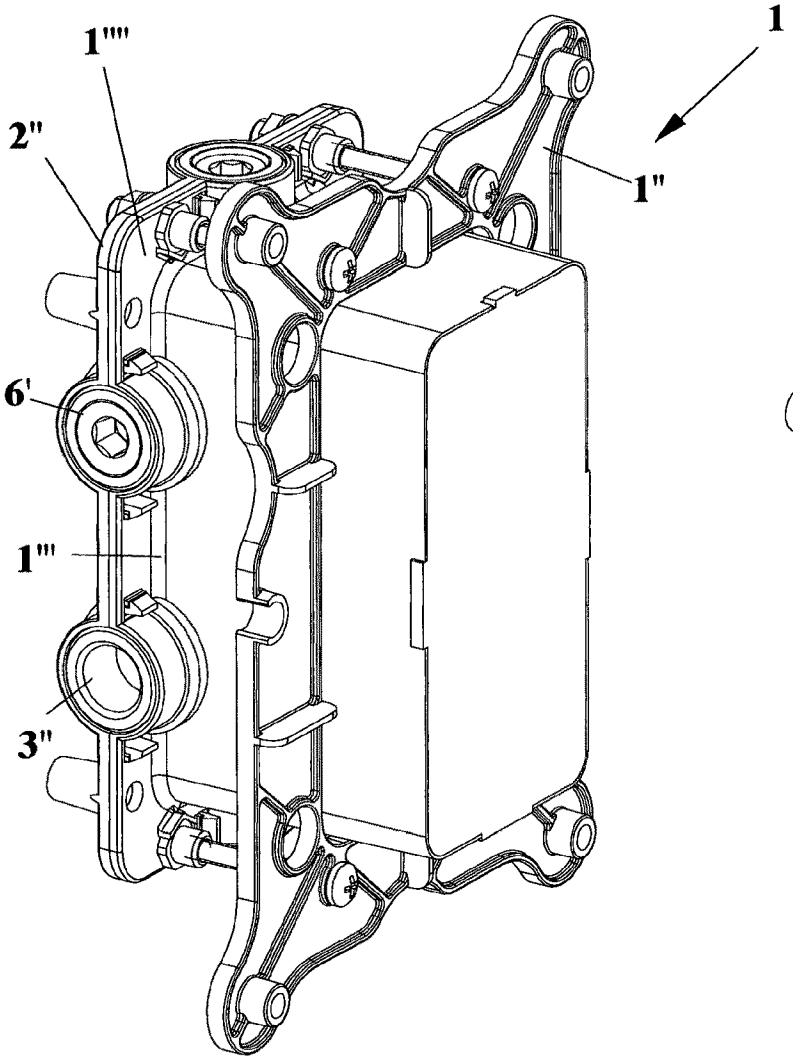

With reference to the above mentioned figures, FIGS. 1A to 1C show, by respective perspective views, the universal embedding system according to the present invention.

Figure 3:
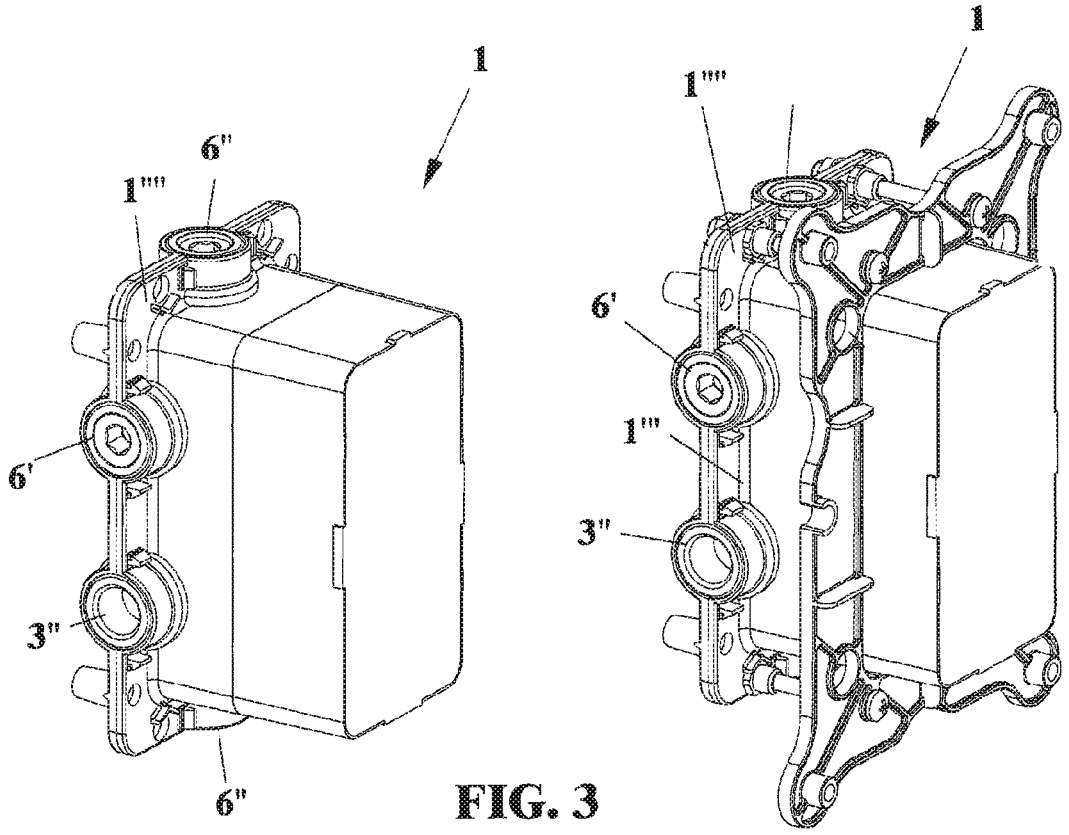
FIG. 3 is yet another perspective view of a fitting of the inventive embedding system including an affixing plate aiding a dry type of assembling.

The inventive system comprises a universal embedding macro-group, generally indicated by the reference number 1, comprising a box-like body 1' (FIG. 15 applied to FIG. 16 to form the box casing, FIG. 17 a fitting as shown in FIG. 3), a front plate 1" removably associated with the box body 1', a rear plate 2", also is removably associated with the box body 1' by snap coupling elements ("snap-fit" coupling) to a further plate-like portion 1''', 1'''' of the box body or casing-housing 1'.

FIG. 1B shows a macro-group of modular functional elements, being generally indicated by 1B.

FIG. 1C shows a macro-group 1C of aesthetic parts, for example comprising a precious material such as brass/chromed zamak which, in the example shown, comprises a top knob M1 and a bottom knob M2, said aesthetic macro-group 1C being designed to be removably coupled to the modular functional element 1B to cover the latter for finishing aesthetic purposes.

In this case, the knobs M' and M" would allow, for example, to operate or drive as desired the spindles of the valve assemblies 1B" and 1B'''', respectively.

Figure 2:
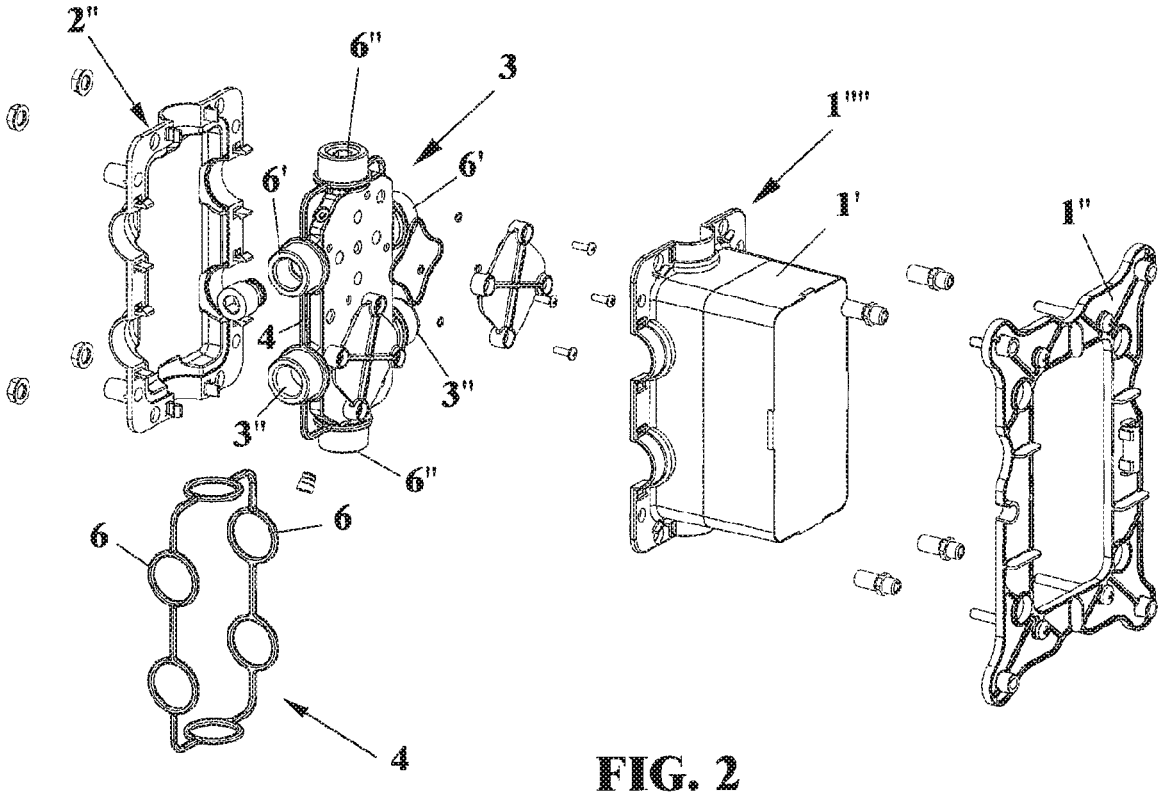
FIG. 2 shows, by a further perspective exploded view, further main components of the embedding system according to the present invention.

With reference to FIG. 2, is herein shown a further exploded perspective view of the embedding macro-group, including a manifold 3 associated with two plates and related hydraulic sealing gasket, the protective box or casing being in this embodiment constituted by two embedding opposite elements facing the mentioned shaped gasket 4" thereby, in case of a water leakage, said water will be conveyed outward.

The manifold 3 according to the present invention comprises two inlets, that is two side inlets 3" and four side outlets 6' and 6".

According to a further aspect of the present invention, with said manifold 3 is removably associated a gasket 4 made of a substantially resilient material and comprising a plurality of annular elements 6 for snap coupling with the two inlets and four outlets of the manifold 3.

FIG. 3 shows a hydraulic fitting of the universal embedding system with associated a clamping plate adapted to facilitate a dry assembling.

Figure 4:
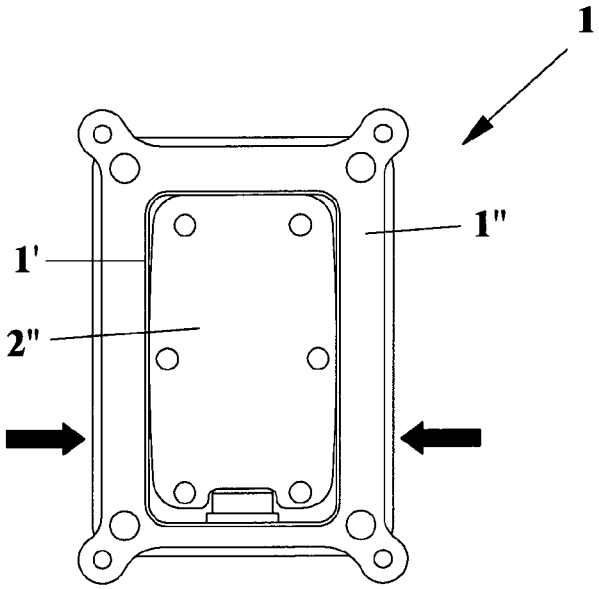
FIGS. 4, 4A, 4B and 4C show a method for selecting an assembling direction of the embedding system according to four different preset assembling configurations mutually turned through 90°.
Figure 4A:
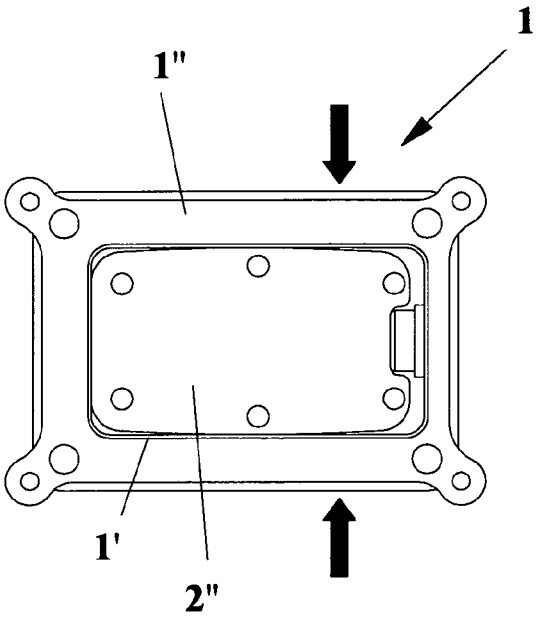
Figure 4B:
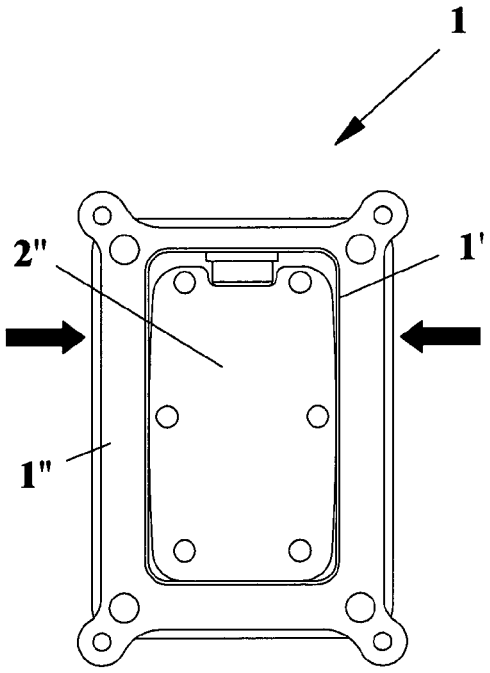
Figure 4C:
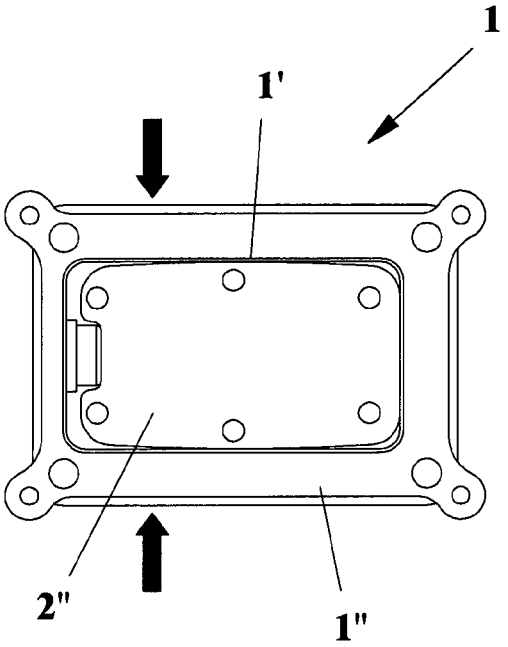

FIGS. 4 to 4C show a possible manner for selecting an assembling orientation of the embedding macro-group, in which, according to the invention, it is possible to select the assembling direction among the four assembling manners shown in FIGS. 4 to 4C in order to use a same embedding group to achieve, after having coupled all the desired functional groups, four modified embodiments of the finished product for each configuration, for example a mouth with a right drive or with a left drive, or with a top drive or a bottom drive mouth, each assembling position being achieved, starting from the position shown in FIG. 4, by further turning movements of substantially 90° in an anti-clockwise direction, from FIG. 4 to FIG. 4C.

Figure 5:
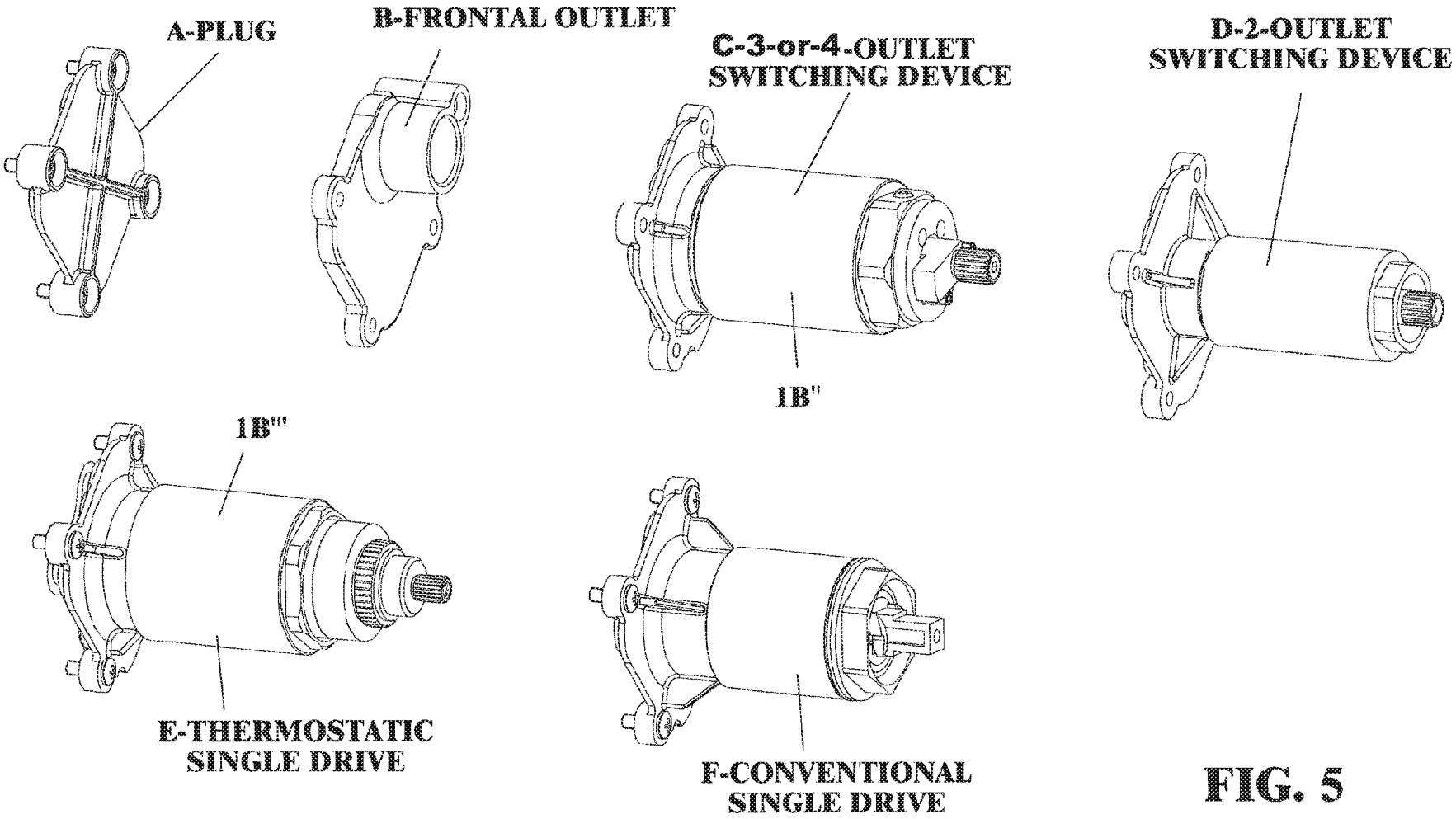
FIG. 5 is yet another perspective exploded view showing further functional components of the embedding structure according to the present invention.

FIG. 5 shows a further perspective view of the universal embedding system according to the present invention, showing in particular functional components thereof, that is six technical groups shown in FIG. 5 to achieve the following different functional combinations.

More specifically, by the functional elements shown in FIG. 5, it will be possible, as one skilled in the art would understand, the following combinations:

1—a conventional mixing single command or drive (F+A); 2—a thermostatic mixing single drive (E+A); 3—a conventional mixing single drive+a 2-way switching device (for coplanar outlets to the water fittings) (F+D); 4—a thermostatic mixing single drive+2-way switching device (for coplanar outlets to the water fittings) (E+D); 5—a conventional mixing single drive+a 3-way switching device (for coplanar outlets to the water fittings) (F+C); 6—a thermostatic mixing single drive+a 3-way switching device (for coplanar outlets to the water fittings) (E+C); 7—a conventional mixing single drive+a 4-way switching device (for coplanar outlets to the water fittings) (F+C); 8—a thermostatic mixing single drive+a 4-way switching device (for coplanar outlets to the water fittings) (E+C); 9—a conventional mixing single drive+a front outlet (F+B); 10—a thermostatic mixing single drive+a front outlet (E+B).

Figure 6:
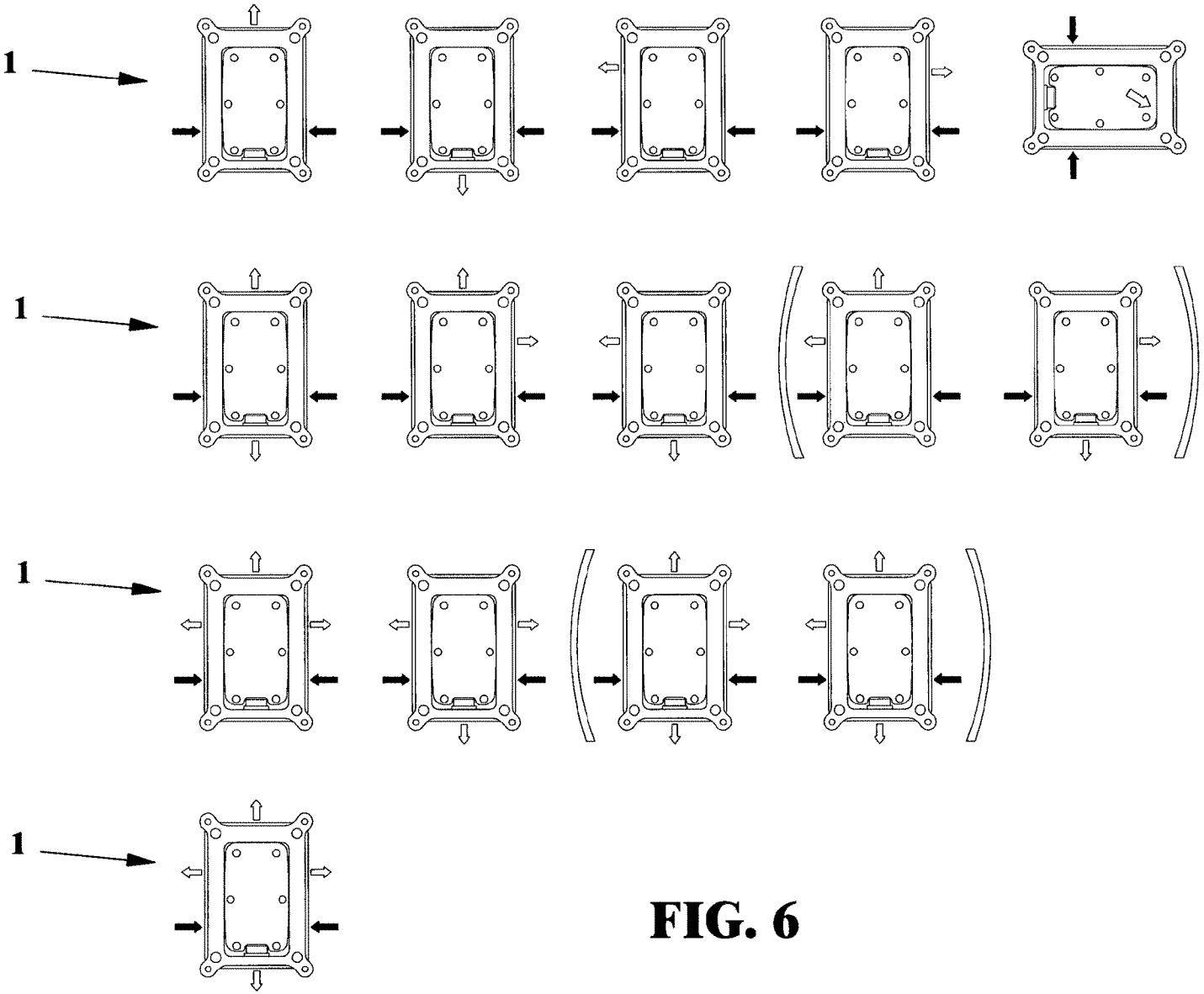
FIG. 6 is a schematic view showing possible configurations and numbers of outlets which may be freely selected by an assembler.

With reference to FIG. 6, is herein shown a possible manner for to selecting the outlets in a universal embedding system according to the present invention: in particular, the number of outlets, that is a maximum of four coplanar outlets or a front outlet and the selection of the outlet to be used will be freely performed by the assembler and, according to the present invention, can be achieved by a possible operating on the rotary drive of the functional component.

Figure 7:
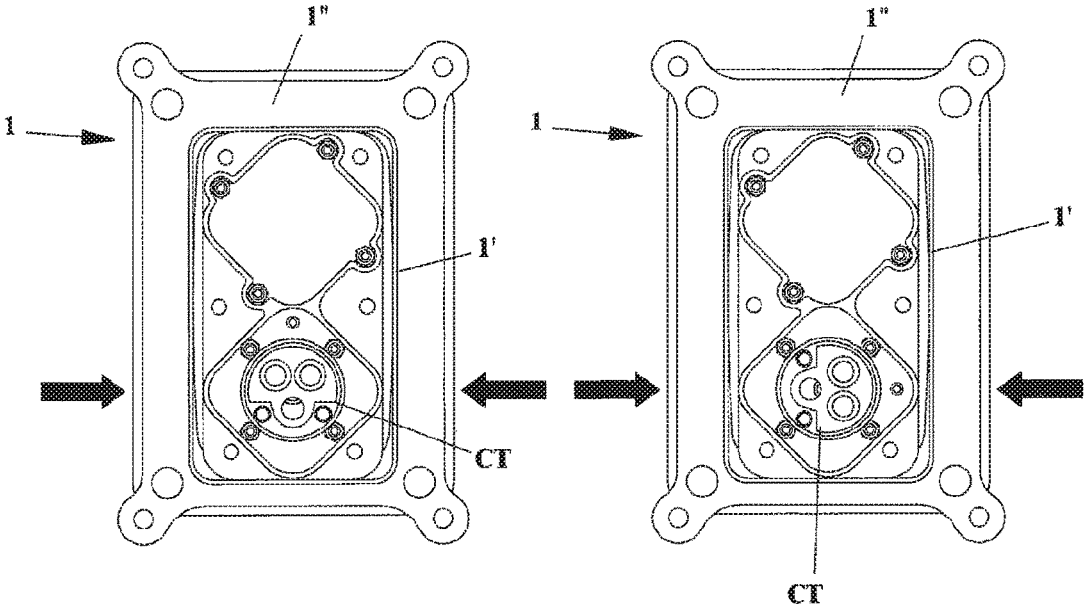
FIG. 7 shows a schematic view illustrating a possibility of reversing the water flows in which in the embedding group or assembly according to the present invention a thermostatic cartridge is mounted.

FIG. 7 shows a further view for explaining a use of the system according to the present invention allowing, in case the system provides to include a thermostatic cartridge CT (hot-cold), to reverse the water flows in a case of an improper installation for a normal operation of the thermostatic cartridge CT, with a restrained cartridge water inlet, without a need of operating on the embedding body fittings, and mainly without the need of performing masonry operations, since it would be possible to merely operate on a rotary movement of the thermostatic drive CT which, in FIG. 7, has been shown on a left position, turned through substantially 90° in a clockwise direction with respect to its position on the right.

Figure 8:
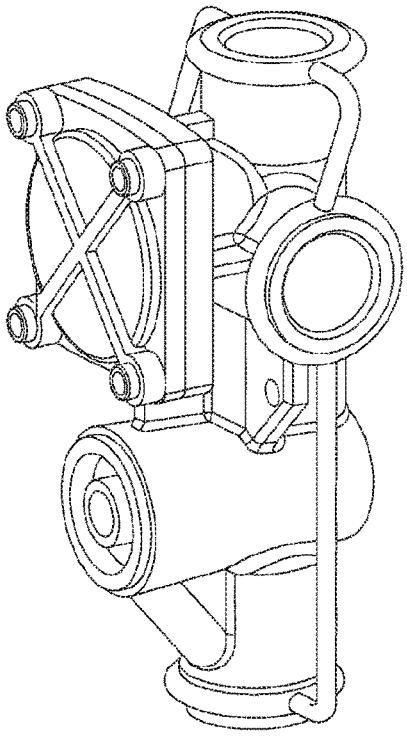
FIG. 8 Prior Art
FIG. 8 shows a system of gaskets adapted to be snap applied for the two inlets and the two outlets of an embedding manifold system of the prior art.

FIG. 8 shows a prior art related view for further showing that the Applicant's gasket system is similar for configuration to a prior commercially available gasket system, including two latching frames with a snap type of coupling, and in which, however, the Applicant's sealing system comprises a contoured or shaped gasket insulating not only the top region of the embedding but also allowing a water flow inside the casing even for its bottom region.

Figure 9:
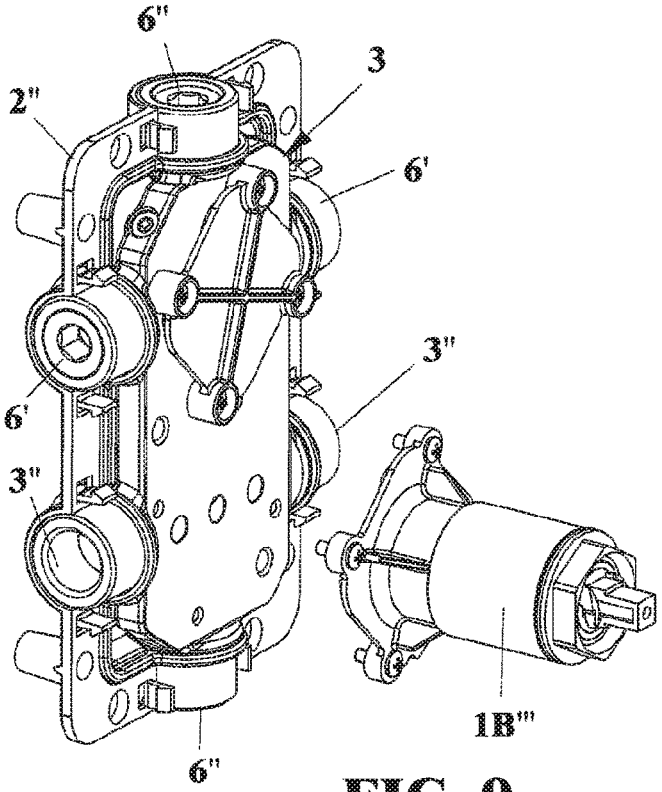
FIG. 9 is a schematic perspective view further showing a possibility of turning functional components allowed by the embedding system according to the present invention.

FIG. 9 shows, finally, a further perspective exploded view for better showing the rotary movements of the functional components.

In fact, for operatively coupling the functional assemblies or groups to the manifold 3', the Applicant has specifically designed a coupling system allowing to turn to four mutually perpendicular positions the functional groups thereby always providing a proper location of the cartridge for opening the related driving rod, independently from a selection of the orientation of the embedding part.

In the case of the above mentioned thermostatic cartridge CT, this system would allow, as stated, to reverse the water flows without affecting the embedded body fittings.

Vice-versa, in analogous prior systems, are conventionally used flange fixing systems without however any possibility of turning the functional component but merely fixing other components of different machining configurations.

With reference to FIGS. 10 to 27, they show further detail views of the embedding system according to the present invention and in particular of the embedding macro-group itself and several assemblies/functional groups associated therewith, according to the present invention.

Figure 10:
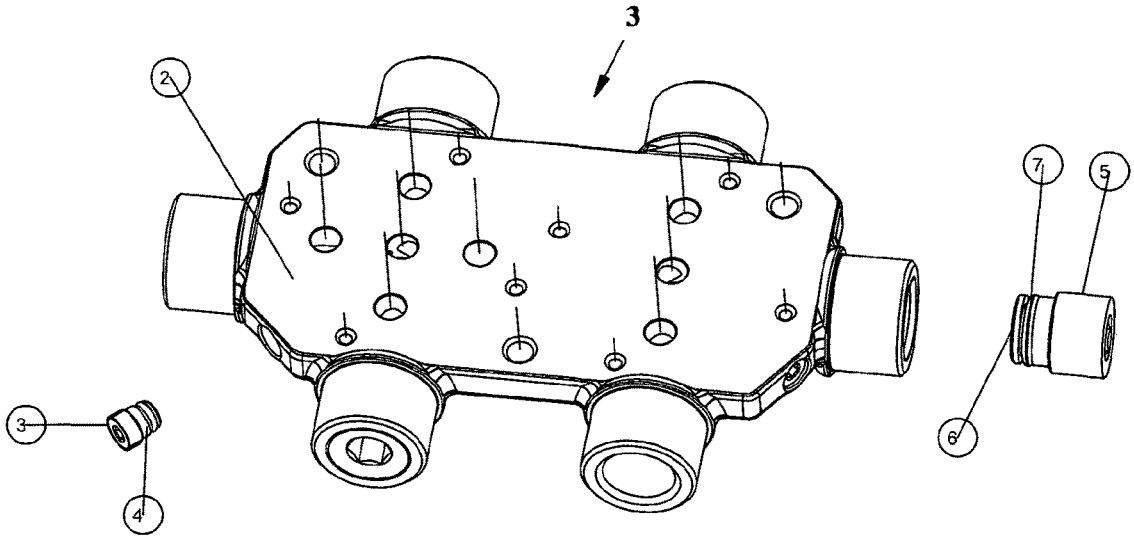
FIGS. 10 to 27 are further detail views of the embedding system according to the present invention and some functional groups associated therewith, and more specifically.
Figure 10A:
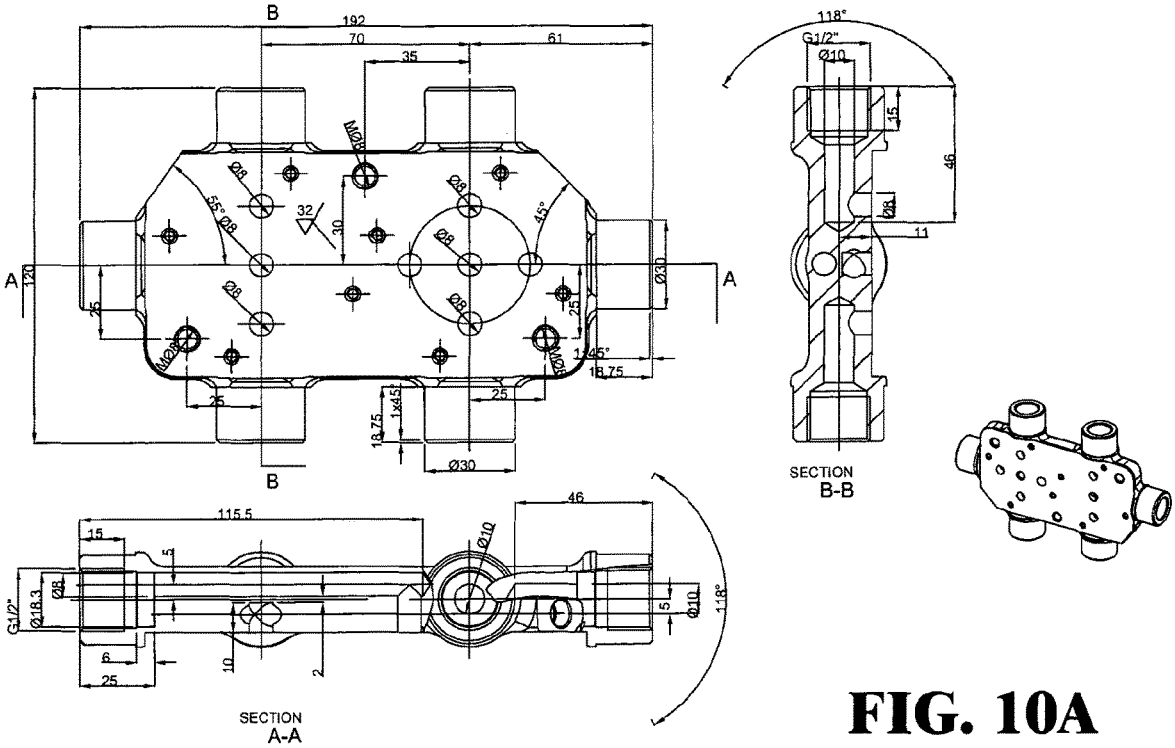
Figure 10B:
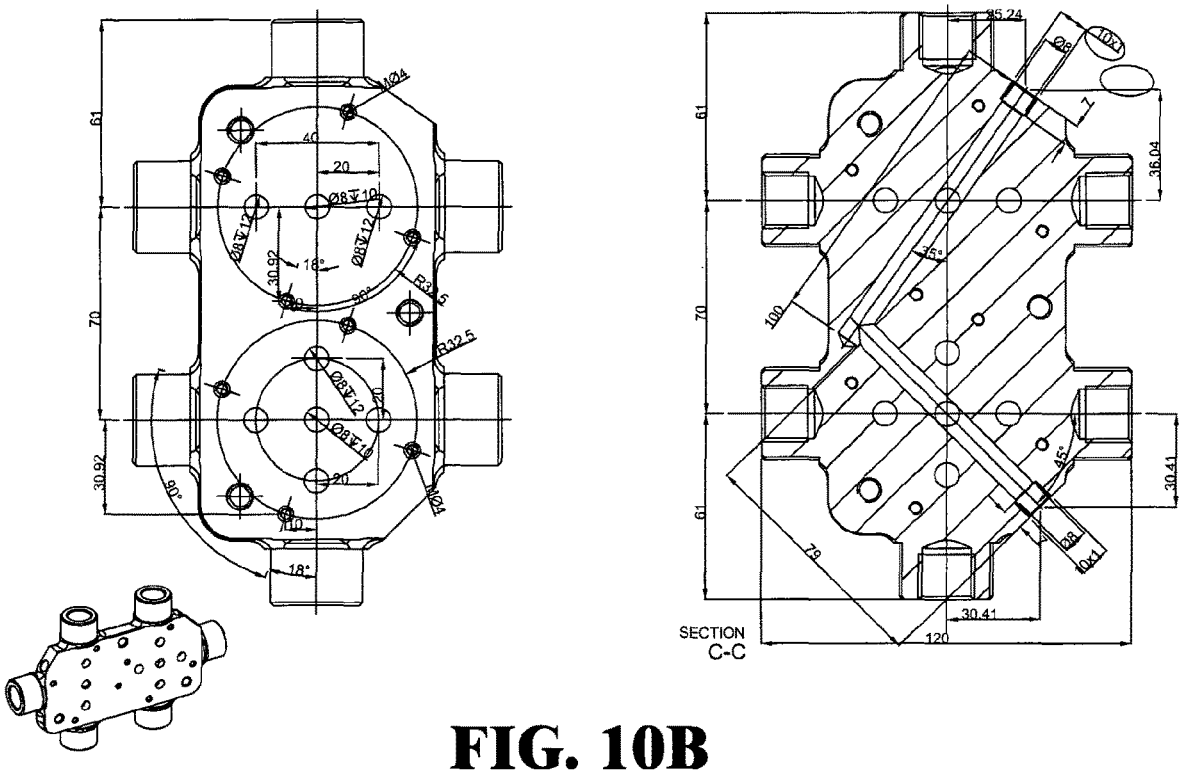
Figure 11:
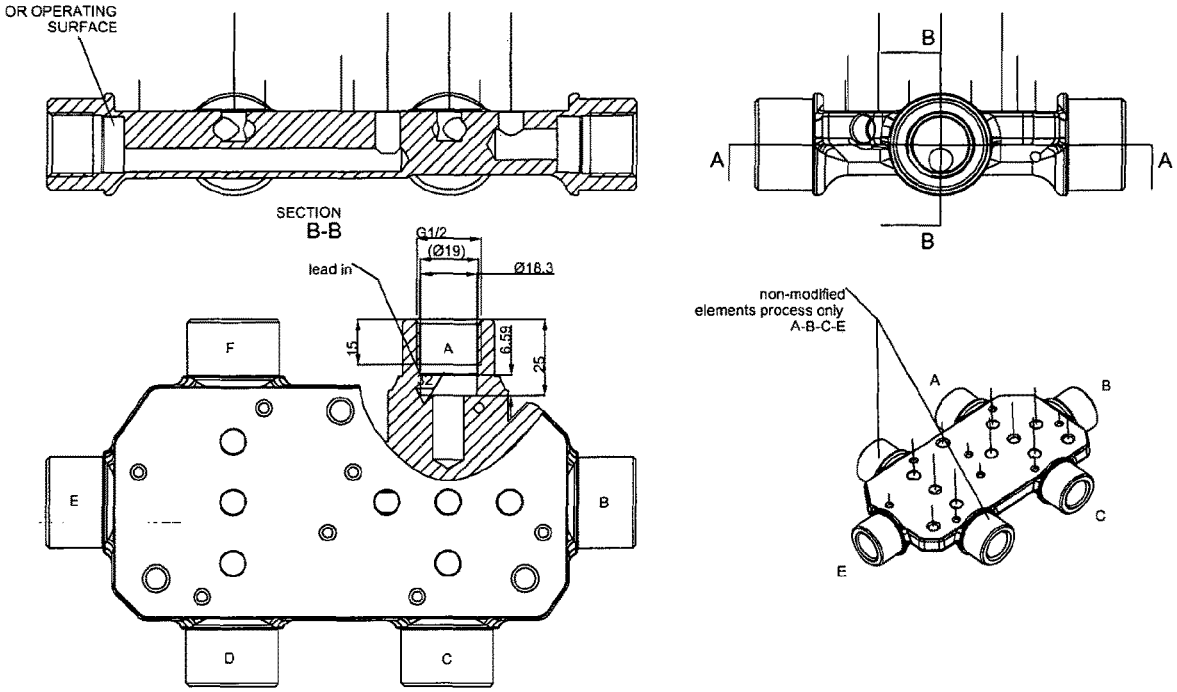

More specifically, with reference to FIGS. 10A, 10B and 11, the embedding macro-group comprise a six-way manifold, having fittings differently machined, specifically designed for its four outlets with respect to those of the two inlets to prevent the related plugs (FIGS. 12 and 13) from being applied with an improper assembling arrangement.

Figure 12:
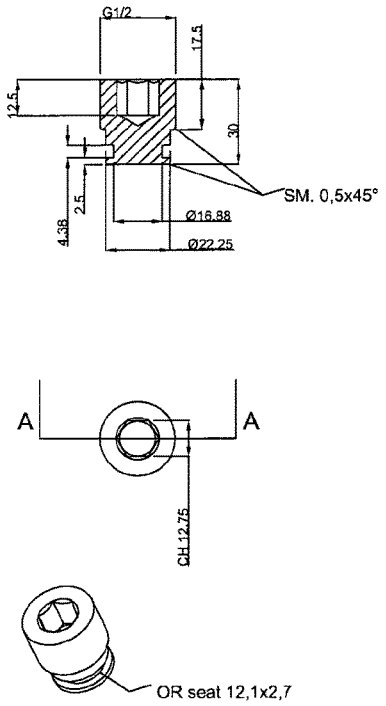
Figure 13:
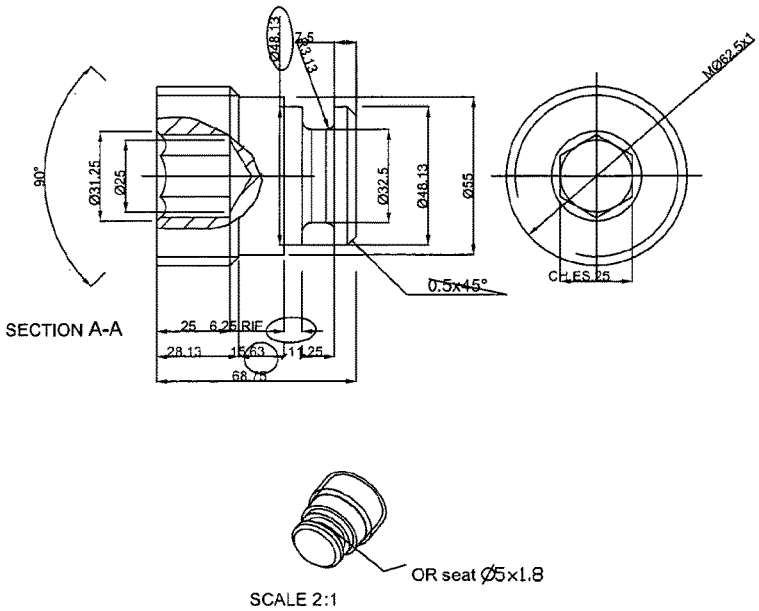

The manifold 3, according to the present invention, is characterized by a machining of the top plane for a suitable coupling with the functional assemblies for machining the slanted water passage, being sealed by the related plugs, that is the embedded plug or outlet of FIG. 12 and the embedded closure plug of FIG. 13.

Figure 14:
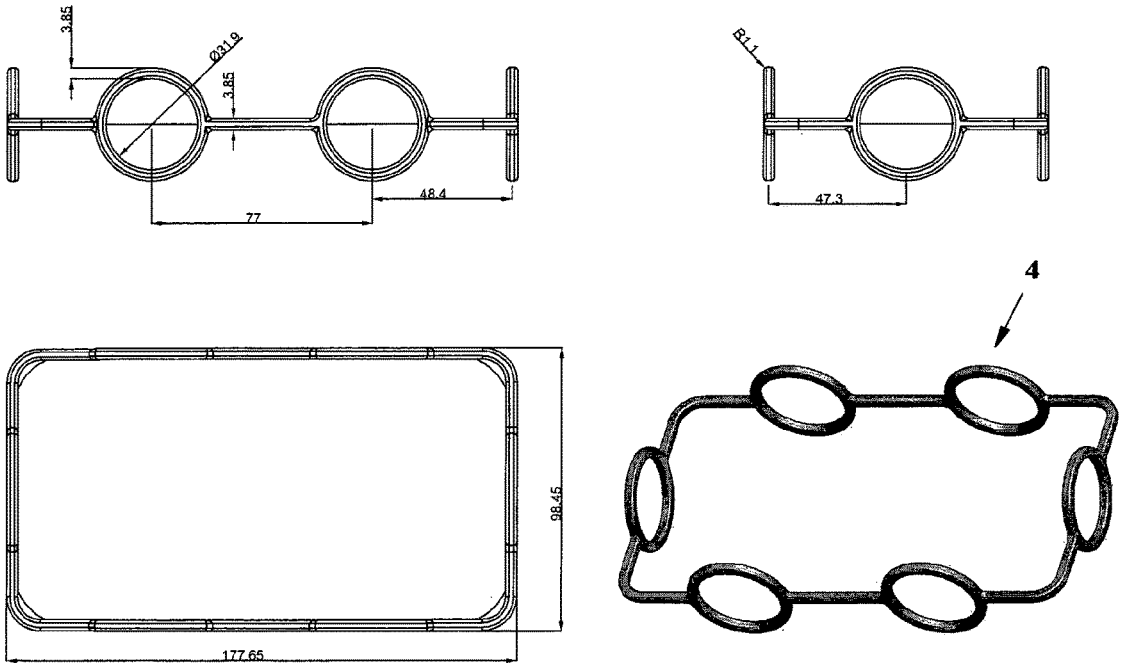

Moreover, each sleeve comprises a machined portion for a suitable locating of the contoured gasket 4 of FIG. 14.

Figure 15:
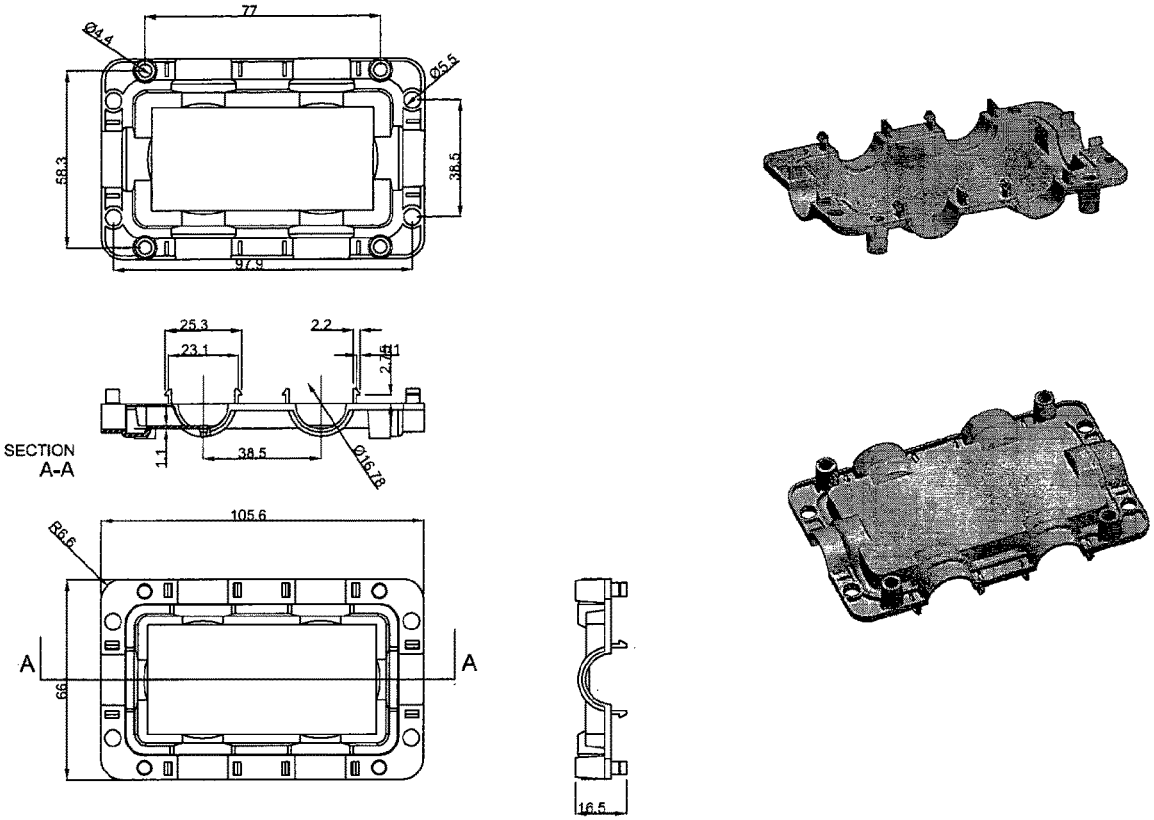
Figure 16:
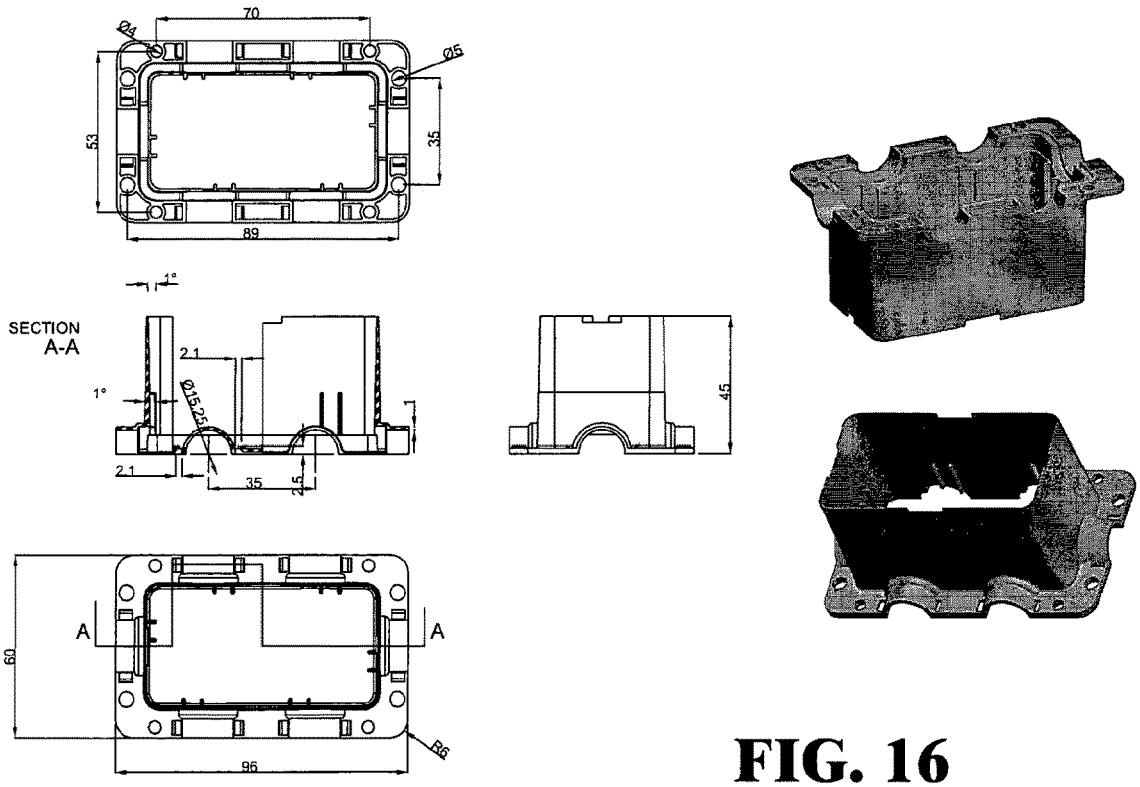

Further components constituting the embedding macro-group of the present invention are the two shells shown in FIGS. 15 and 16, respectively, to be coupled to form the protective casing and being characterized by a provision of snap coupling gasket fittings (snap fit connection) as well as by a provision of inner guides, as shown, to facilitate a proper location of the functional assemblies or groups, the shells of FIGS. 15 and 16 having a configuration mating that of the assembled manifold group 3, which, together with the contoured gasket 4, allow, according to the present invention, to provide a sealed system.

More specifically, FIG. 15 shows perspective, front and top views of the bottom embedding casing or box, whereas FIG. 16 shows corresponding views of the top embedding box or casing.

Figure 17:
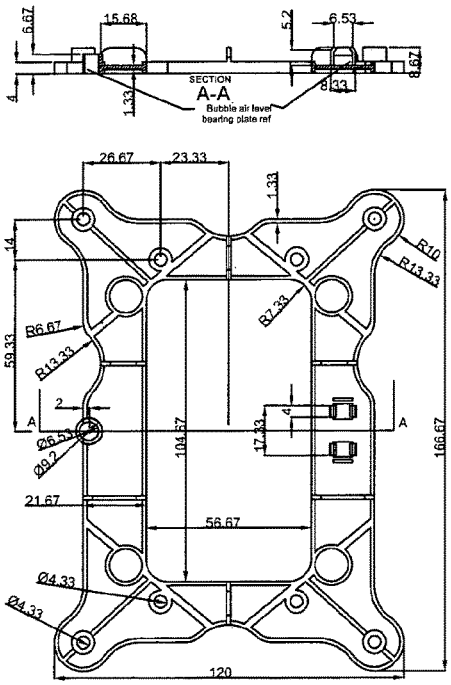

FIG. 17 shows a support plate also constituting a main feature of the present invention.

In fact, the embedding macro-group provides the possibility of applying, by means of screws and bolts, the support plate of FIG. 17 (or depth-plate) adapted to facilitate an assembling by further four fixing points, and having a housing for an air bubble-level and the configuration thereof being specifically designed to facilitate a locating of the air bubble-level even in a perpendicular direction with respect to the piece to verify a proper location of the embedding macro-group.

Figure 18:
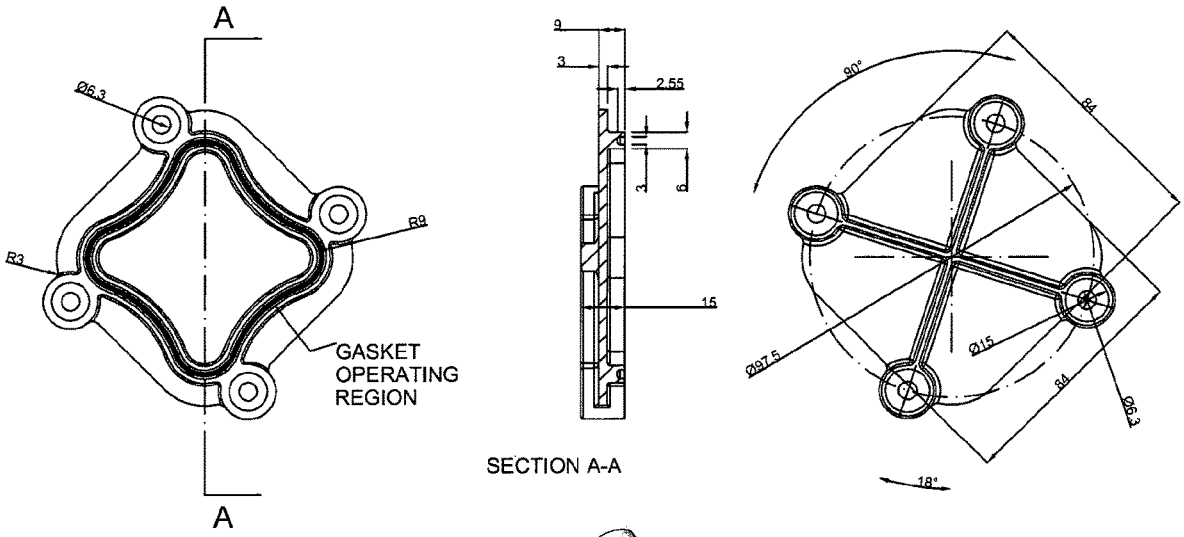
Figure 18:
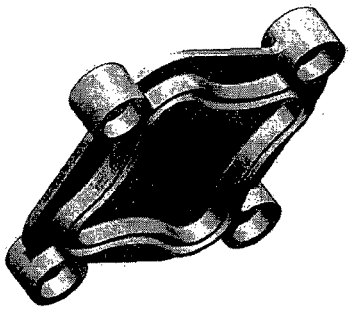

The embedding macro-group further provides to apply the closing plugs, for example the shower plug of FIG. 18 and related gaskets rendering this assembly a fully sealed one, to allow a proper testing and cleaning of the inner channels thereof before applying its functional parts.

Figure 19:
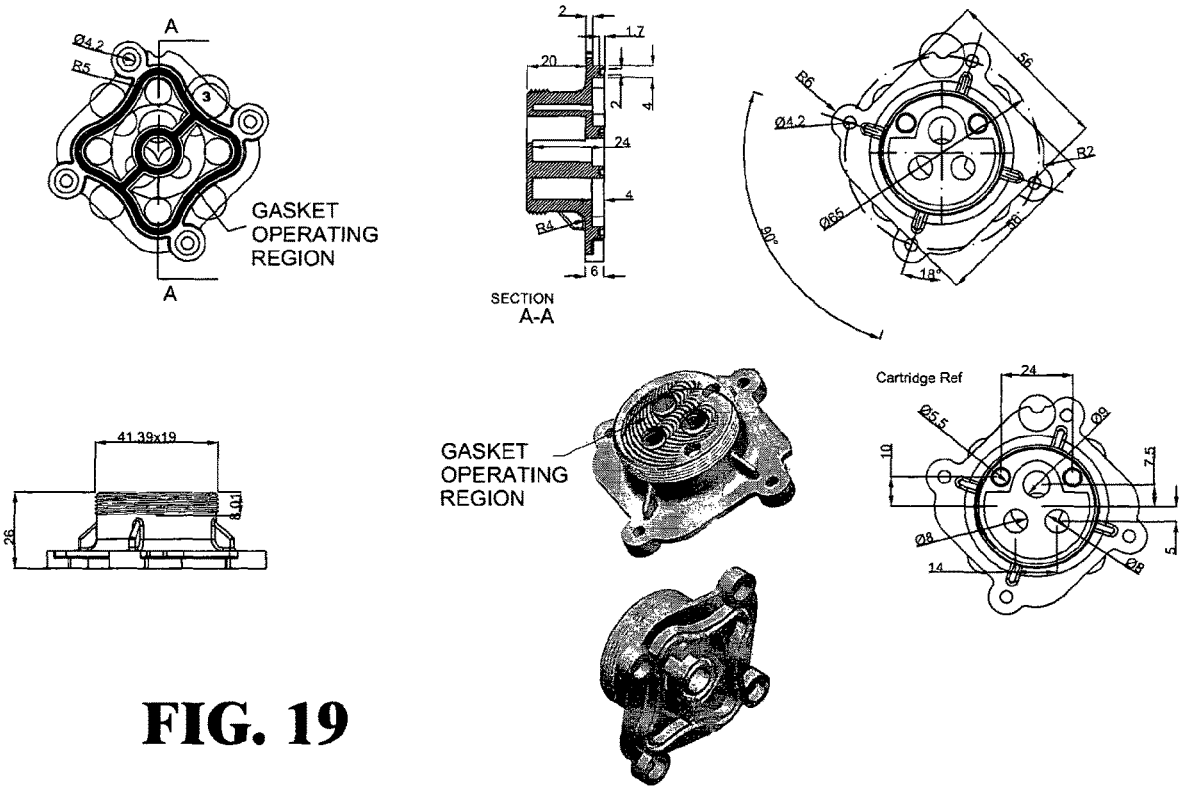

With respect to the mentioned functional groups providing, as disclosed, a use of aesthetic/functional covering cartridges (see also the details c-d-e-f of FIG. 5), each of them comprises an adapter, as shown for example in FIG. 19, an embedding cartridge adapter with the same flange system for clamping to the manifold and configurations which have been specifically designed to allow an orthogonal locating of said functional group, while leaving a possibility of performing a free rotary movement through 90° according to requirements.

According to the present invention, to provide the functional system has been designed a particular geometry of the details communicating each inlet of the cartridge CT with the respective inlet hole on the manifold 3, independently from the orthogonal orientation.

This system, for example in case of a conventional lever single drive, allows to freely direct the embedded assembly while holding a fixed opening direction of the lever whereas, in case of a thermostatic single drive, it allows to reverse, as stated, the inlet water flow without a need of operating on the manifold.

Figure 20:
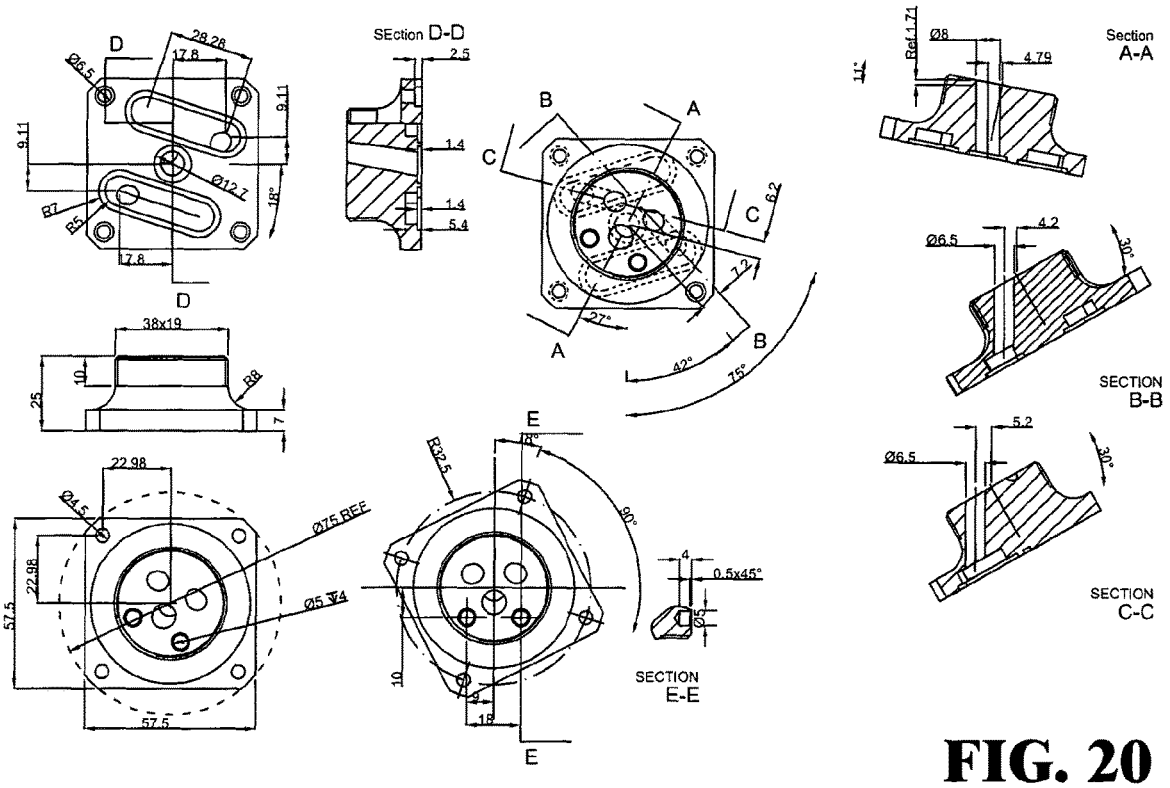
Figure 21:
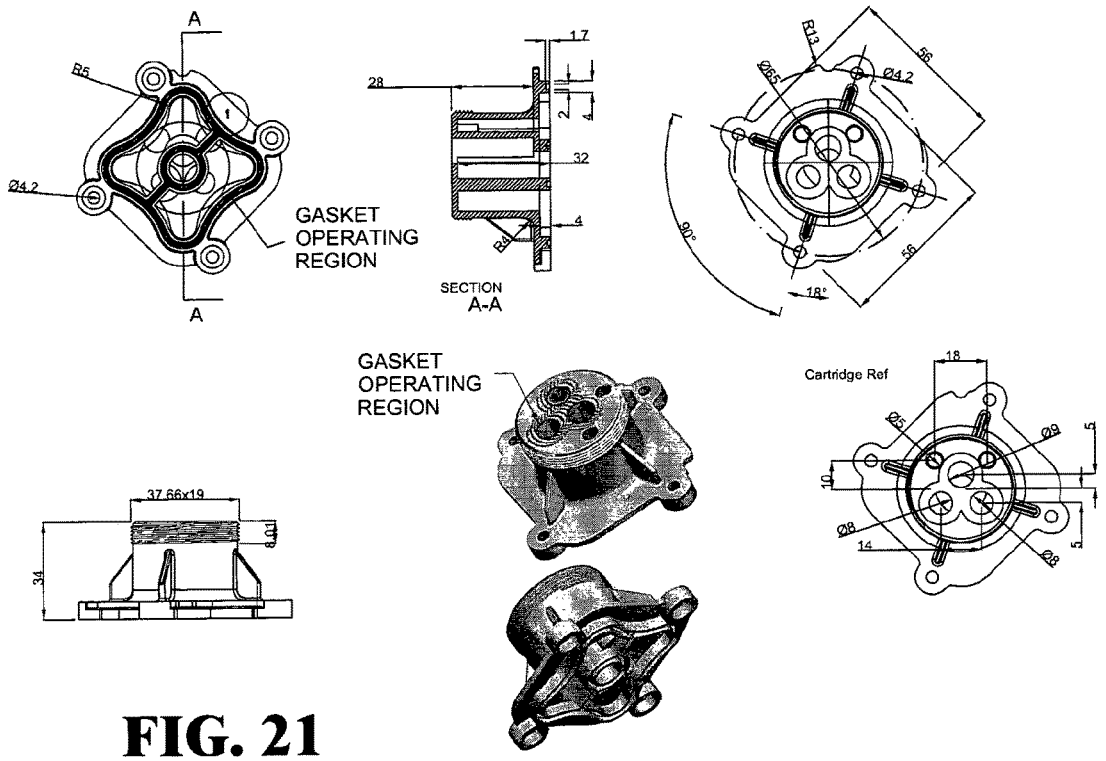
Figure 22:
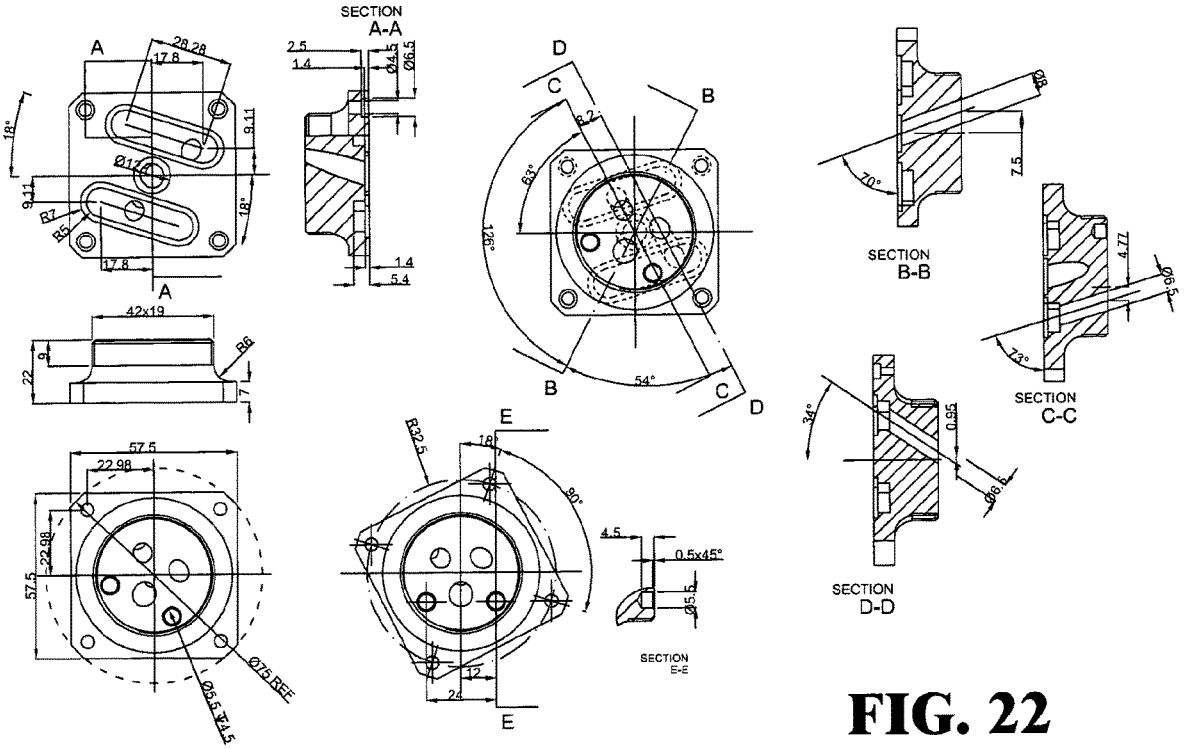
Figure 23:
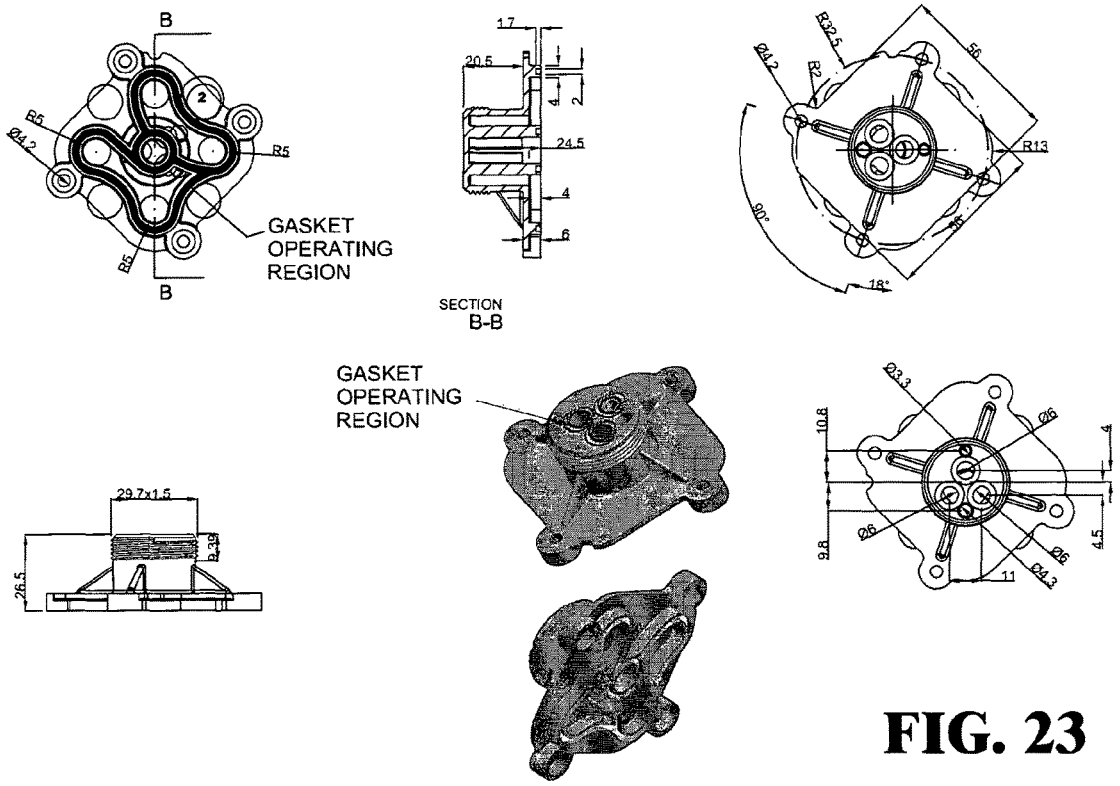

In this connection please make reference to FIG. 21 showing a cartridge adapter; to FIG. 20 showing a modified embodiment of the mixer adapter; to FIG. 19 showing a coaxial thermostatic cartridge adapter; to FIG. 22 showing an adapter-mixer; and to FIG. 23 showing a two-outlet switching adapter.

By way of a further example, in case of a functional switching assembly including two outlets, the particular configuration of the adapter herein provided allows to communicate each cartridge outlet with two outlets of the manifold while allowing to freely select the sleeve to be used among the four available outlets.

Figure 24:
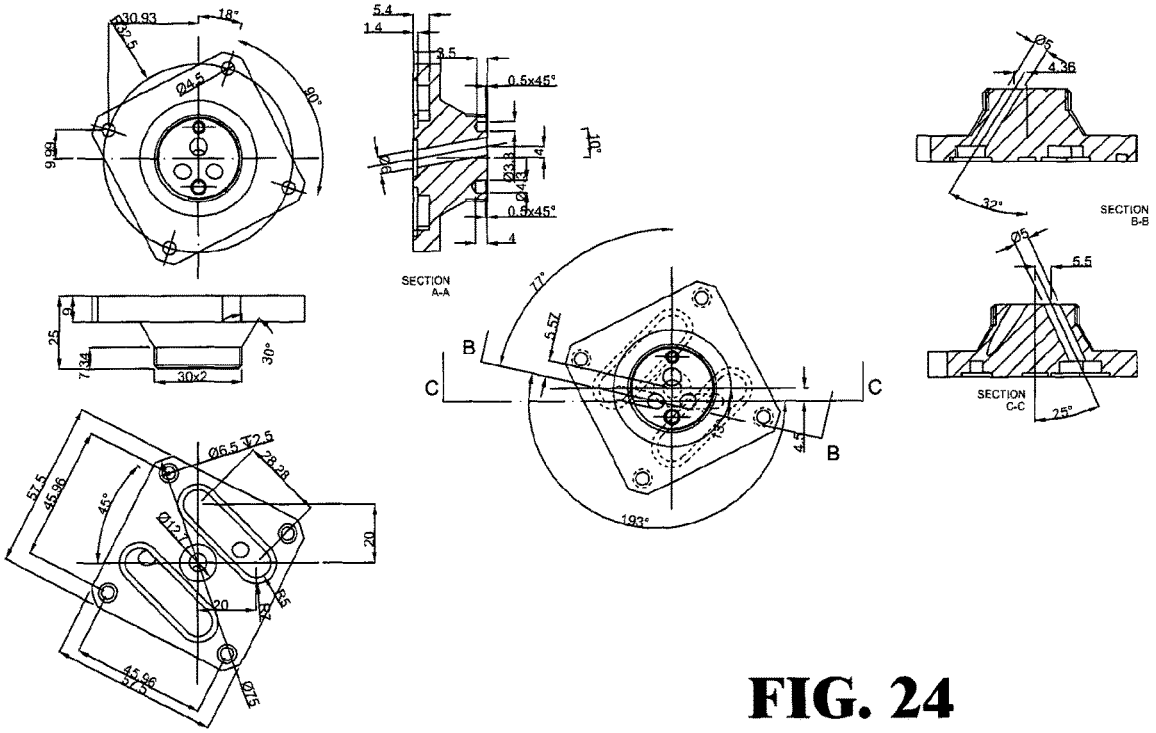
Figure 25:
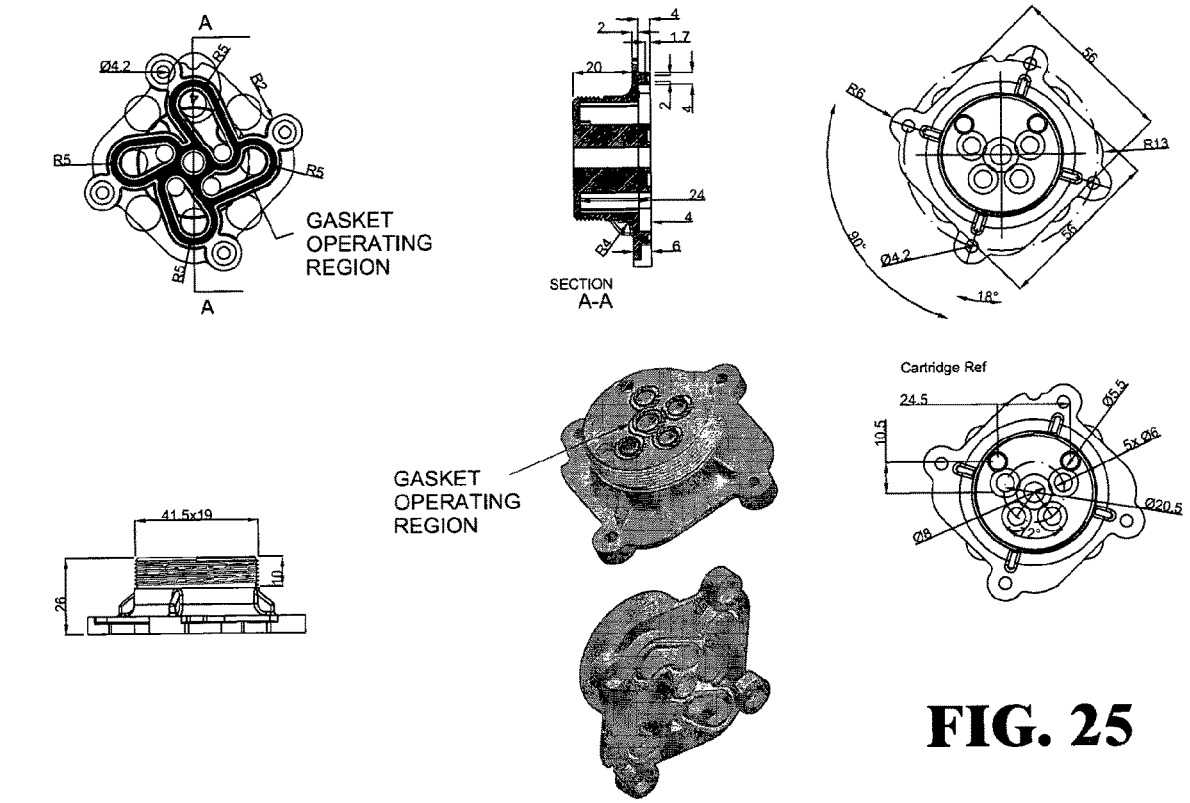
Figure 26:
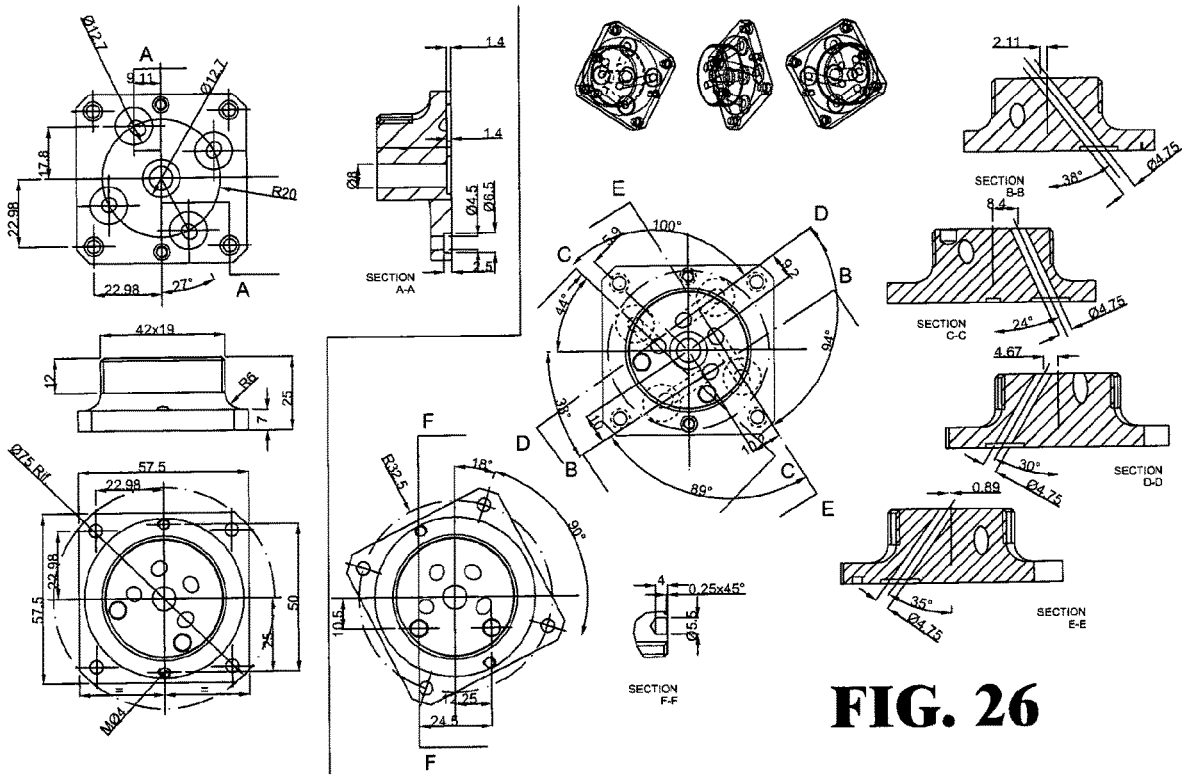
Figure 27:
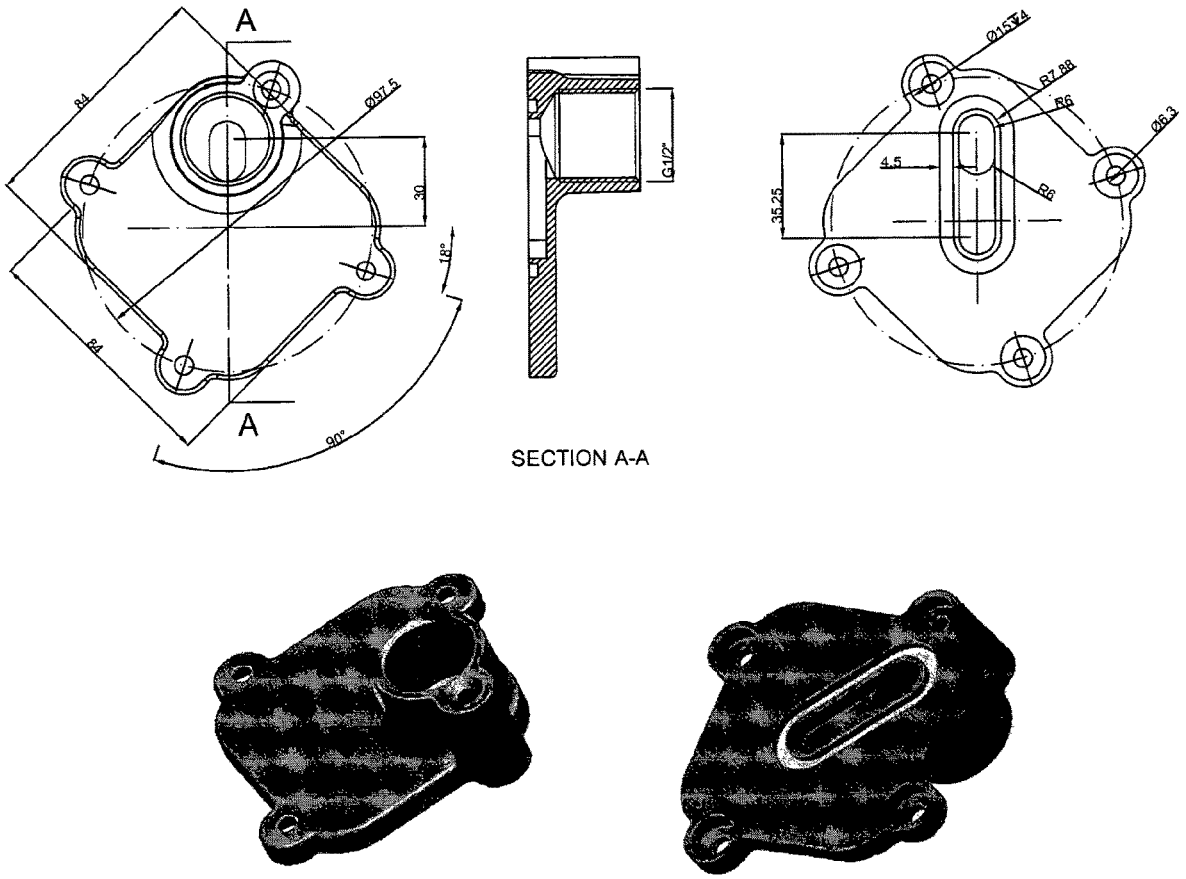

Please also make reference to FIG. 24 in which are shown main views of the two-outlet adapter/switching device; to FIG. 25 showing a four-outlet adapter/switching device; to FIG. 26 showing a four-outlet switching cartridge adapter; and to FIG. 27 showing a preferred embodiment of the "mouth" adapter.

Advantageously, for the above disclosed functional adapters and assemblies, the same flange system is held, for clamping to the manifold 3 and with a specifically designed configuration to allow said functional assembly to be orthogonally arranged while leaving a possibility of performing a free rotary movement through 90°, according to requirements, for example in case of a coupling of a three-way configuration adapter to choose which one of the four outlets will not be used.

With respect to the "mouth" adapter and related gasket, they also comprise advantageously, according to the invention, the same flange system for clamping to the manifold and the same outer configuration compatible with the embedding top casing guides.

From the above disclosure it should be apparent that the invention fully achieves the intended aim and objects.

In fact, the Applicant has provided a universal embedding system which, differently from all the prior art systems including two inlets and two outlets, provides to use a manifold assembly or group having two inlets and four outlets.

Thus, it is possible to provide an increased number of functional components by using the same embedding macro-group and, for example, departing from the shower application by providing a use even for a front outlet embedding mixer, for example a basin mouth of an integrated drive embedding type.

Moreover, owing to the inventive idea to split the functional components/groups into single groups having a single function (for example either mixer only or switching assembly only), the number of components/groups which may be made is greatly increased by the possibility of turning through 90° the orientation of each component/assembly.

Although the invention has been disclosed with reference to a preferred embodiment thereof, this embodiment is susceptible to several modifications and variations all coming within the inventive idea.

In particular, the contingent materials and size may be any, according to requirements.

The invention claimed is:

1. An embedding system for sanitary fittings, comprising three macro-groups adapted to be removably functionally associated with each other, said macro-groups comprising a first universal embedding macro-group with a manifold body, a second macro-group of functional components/groups and a third macro-group of aesthetic parts, wherein said second macro-group of functional components/groups comprises two single modular elements including a first element having a switching function and a second element having a mixing function, and each element being adapted to be mounted to said manifold body in a plurality of mounting positions, with each mounting position being rotated relative to another mounting position, wherein said universal embedding macro-group is adapted to be installed in a plurality of installation positions, each installation position being rotated relative to at least one of the other plurality of installation positions, thereby capable of providing a plurality of different finished product embodiments;

said manifold body having a plurality of ports comprising a plurality of inlets and a plurality of outlets disposed between a protective casing, said functional components/groups including at least one of shower groups, shower groups with switching devices, front outlet mixing groups and embedding mouth assemblies with a built-in drive.

2. The embedding system of claim 1, wherein said protective casing comprises two snap-fit coupled shell elements, each said shell element including inner guides to facilitate a locating of said functional components in said casing, said casing having a shape complementary to that of said manifold body, between said shell elements being arranged a contoured sealing gasket.

3. The embedding system of claim 1, wherein said system comprises a number of said functional components/groups to be associated with said first universal embedding macro-group to provide at least the following ten functional combinations:

1—a conventional mixing single command or drive; 2—a thermostatic mixing single drive; 3—a conventional mixing single drive+a 2-way switching device; 4—a thermostatic mixing single drive+a 2-way switching device; 5—a conventional mixing single drive+a 3-way switching device; 6—a thermostatic mixing single drive+a 3-way switching device; 7—a conventional mixing single drive+a 4-way switching device; 8—a thermostatic mixing single drive+a 4-way switching device; 9—a conventional mixing single drive+a front outlet; and 10—a thermostatic mixing single drive+a front outlet.

4. The embedding system of claim 1, wherein a sealing gasket is made of a resilient material and comprises a plurality of integral annular elements, one or more of which may be tightly snap engaged in inlets of said manifold body and one or more of which may be tightly snap engaged in outlets of said manifold body.

5. The embedding system of claim 1, wherein said first universal embedding macro-group may be removably associated with a support plate adapted to facilitate a dry assembling of said system and to further facilitate the assembling of said embedding system.

* * * * *